United States Patent [19]

Pasquarella

[11] Patent Number: 4,697,221

[45] Date of Patent: Sep. 29, 1987

[54] PORTABLE ACTUATOR FOR INDUCTIVE LOAD

[75] Inventor: Stephen T. Pasquarella, Rochester, N.Y.

[73] Assignee: VA Inc., Rochester, N.Y.

[21] Appl. No.: 912,644

[22] Filed: Sep. 29, 1986

Related U.S. Application Data

[62] Division of Ser. No. 783,156, Oct. 2, 1985, abandoned.

[51] Int. Cl.[4] ..... H01H 47/32

[52] U.S. Cl. ..... 361/156; 361/187; 361/194

[58] Field of Search ..... 361/155, 156, 187, 190, 361/194, 203, 205; 354/463, 464

[56] References Cited

U.S. PATENT DOCUMENTS

| | | | |
|---|---|---|---|
| 3,243,683 | 3/1966 | Ackley | 307/110 X |
| 3,526,821 | 9/1970 | Thomas | 363/61 X |
| 3,863,128 | 1/1975 | Wilwerding | 320/21 |
| 3,864,608 | 2/1975 | Normile et al. | 361/194 X |
| 4,130,780 | 12/1978 | Ban et al. | 320/1 X |
| 4,295,177 | 10/1981 | Woodhouse et al. | 361/194 X |
| 4,298,827 | 11/1981 | Nakajima | 320/1 X |
| 4,327,394 | 4/1982 | Harper | 361/187 X |
| 4,513,345 | 4/1985 | Pasquarella | 361/155 |

*Primary Examiner*—Michael L. Gellner
*Attorney, Agent, or Firm*—Hoffman Stone

[57] ABSTRACT

A battery operated, portable actuator for an inductive load such as an electromagnetically actuatable photographic shutter includes an initiating capacitor for initiating acutation of the load, and a continuing holding circuit portion for continuing energizing the load after discharge of the initiating capacitor. The capacitor is connected to be charged by the output of a voltage multiplying rectifier which is alternately turned ON and OFF according to the instantaneous voltage across the capacitor, being turned ON when the voltage is low, and OFF when the voltage is high. The continuing circuit portion is arranged to feed time-spaced current pulses to the load, and a diode is connected across the load so that its own inductive nature holds it energized during the intervals between the pulses. The duration of the energizing current pulses is increased in response to fall-off of the battery output voltage. All of these features combine to enhance the effective life of the battery, minimizing current drain on it, while simultaneously ensuring reliable operation of the load.

3 Claims, 9 Drawing Figures

PORTABLE ACTUATOR FOR INDUCTIVE LOAD

This application is a division of Ser. No. 783,156, filed Oct. 2, 1985, now abandoned.

This invention relates to a novel protable actuator for an inductive load. The circuit was devised to provide a portable, battery operated circuit for use as an alternative to the circuit described and claimed in my U.S. Pat. No. 4,513,345, which has been used primarily for operating an electromagnetically driven photographic shutter of the kind described in U.S. Pat. No. 3,664,251.

The prior circuit is energized from a continuous power source such as household electric current, and draws more power than can be supplied by a small battery for more than a relatively few cycles of operation. The circuit of the present invention is surprisingly efficient in energy consumption and enables fairly extended operation of the shutter over many cycles or continuously for relatively long periods using only a commonly available nine volt alkaline battery. For example, a nine volt alkaline battery of the kind commonly used in portable radio receivers can maintain the circuit in standby condition for over sixteen hours, supply the circuit for over one thousand two-second operations of the shutter, or can hold the shutter open continuously for over an hour.

The principal features of the circuit relate to maximizing the economy and efficiency of energy use. For one thing, a voltage multiplying rectifier is used to charge a relatively large capacitor, the discharge of which is applied for initiating energization of the load. The capacitor, however, is not constantly fed by the rectifier; instead, once it becomes charged to a first preselected voltage, the rectifier is switched off until the voltage across the capacitor dwindles to a second, lower, preselected voltage. The capacitor is selected as one having a relatively low leakage characteristic so that while the circuit is in its standby condition (the load remaining unenergized) the rectifier is switched on only about ten per cent of the time, i.e., about a ten per cent duty cycle, thus minimizing the drain on the battery required to maintain the capacitor adequately charged. Capacitors of the desired kind are readily obtainable at reasonable cost.

A second feature relates to the method of energizing the inductive load. Instead of feeding current to the load at a constant rate to hold it energized for a substantial length of time, current is fed in pulses and the inductive characteristic of the load itself is relied on to maintain the necessary current during the intervals between the pulses. It has been found that in this way the current required from the actuating circuit to hold the load energized may be reduced by a substantial factor relative to the nominal holding current heretofore thought necessary.

The circuit of the invention was developed, as hereinabove described, primarily for actuating a photographic shutter of the noted kind, and may be described herein in terms sometimes relating to the shutter, It should be understood, however, that the circuit is not limited to that particular application, but is suitable for driving inductive loads of many different kinds.

BRIEF DESCRIPTION

Briefly, the circuit includes a switching arrangement controlled by an oscillator for producing an alternating current for driving a voltage multiplying rectifier. The output of the rectifier is applied across an initiating capacitor for charging it to a relatively high voltage of, say, about four times the output voltage of the battery. The capacitor is discharged through the load to initiate energization of the load. Once the capacitor is discharged an auxiliary, holding circuit portion takes over to feed current at a relatively low rate to the load to hold it energized, and the initiating capacitor is switched off from the load and recharged. The auxiliary, holding circuit portion is gated to feed current to the load in relatively short pulses on a duty cycle ranging between about 40% and about 60%, depending on the battery voltage.

In the embodiment described, the circuit is designed to be run on a nine volt battery, the output voltage of which, as is well known, varies with many factors such as age, ambient temperature, and load. For this reason the duty cycle of the holding circuit portion is varied inversely to variations in the battery voltage, and the entire circuit is shut down automatically when the battery voltage drops below a predetermined value of, say about 5.5 volts. While the battery voltage remains near its nominal rating of nine volts the holding circuit is driven at about a 40% duty cycle. As the output voltage of the battery falls off the duty cycle is proportionately increased up to about 60% just before the output of the battery reaches the predetermined minimum of 5.5 volts.

A diode is connected across the load to facilitate the pulse feed system of the invention. The inductance of the load maintains the current through it and the diode during the intervals between the applied pulses. The diode is oriented to permit the inductively generated energizing current to flow in the forward direction of the diode, and this turns out to be the blocking direction in respect of the pulses fed from the auxiliary, holding circuit portion so the diode does not load the drive circuit.

DETAILED DESCRIPTION

The circuit of the invention will now be described in detail in conjunction with the accompanying drawings, in which.

Figure 7:
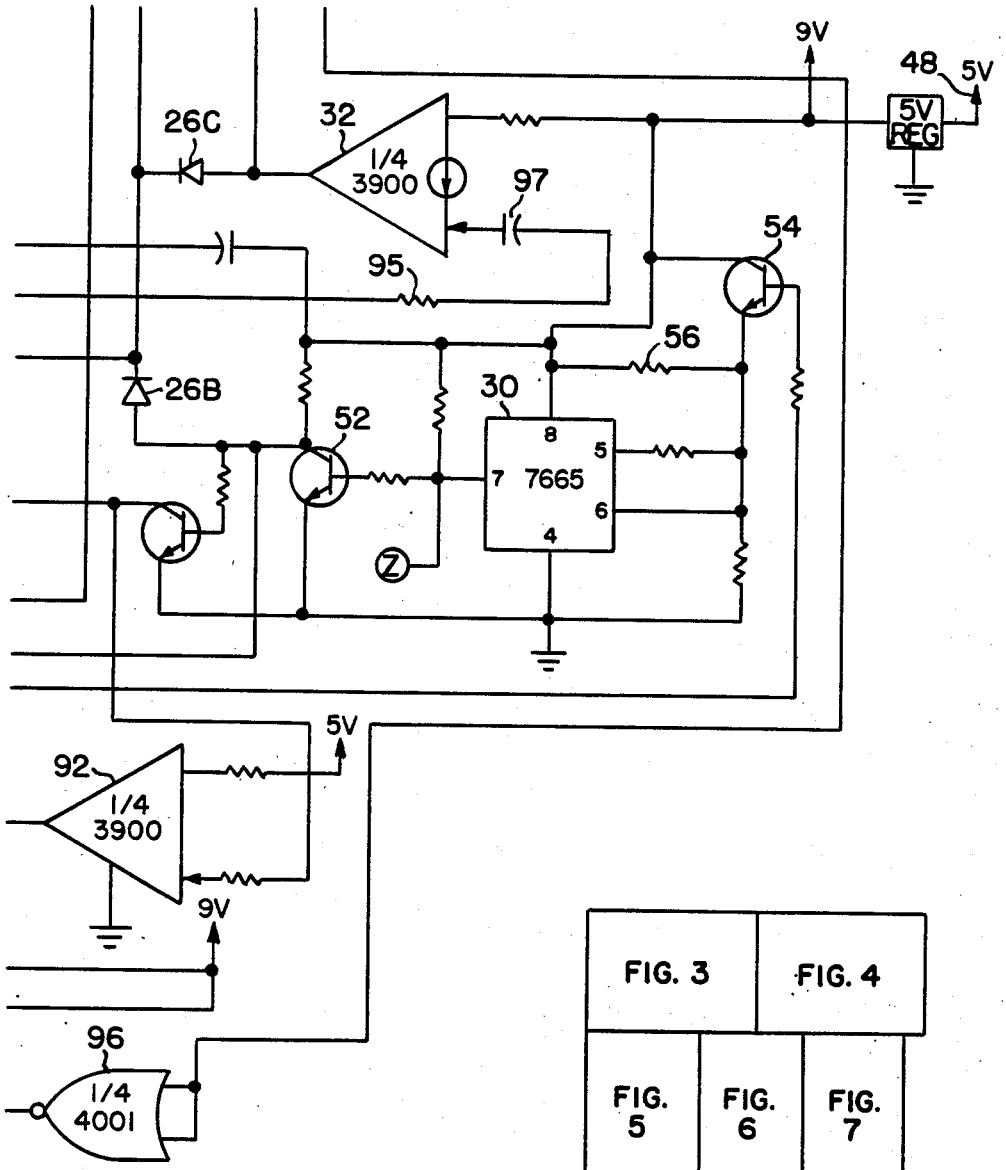
Figure 8:
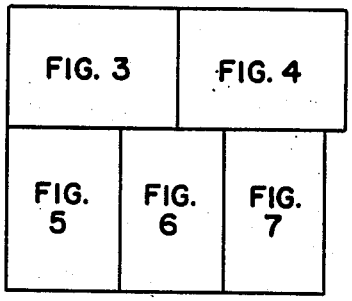

FIGS. 3, 4, 5, 6, and 7, taken together as indicated in FIG. 8, constitute a detailed schematic diagram of the circuit; and FIG. 8 is a diagram showing the assembly of FIGS. 3–7 to form the complete schematic circuit diagram.

Figure 1:
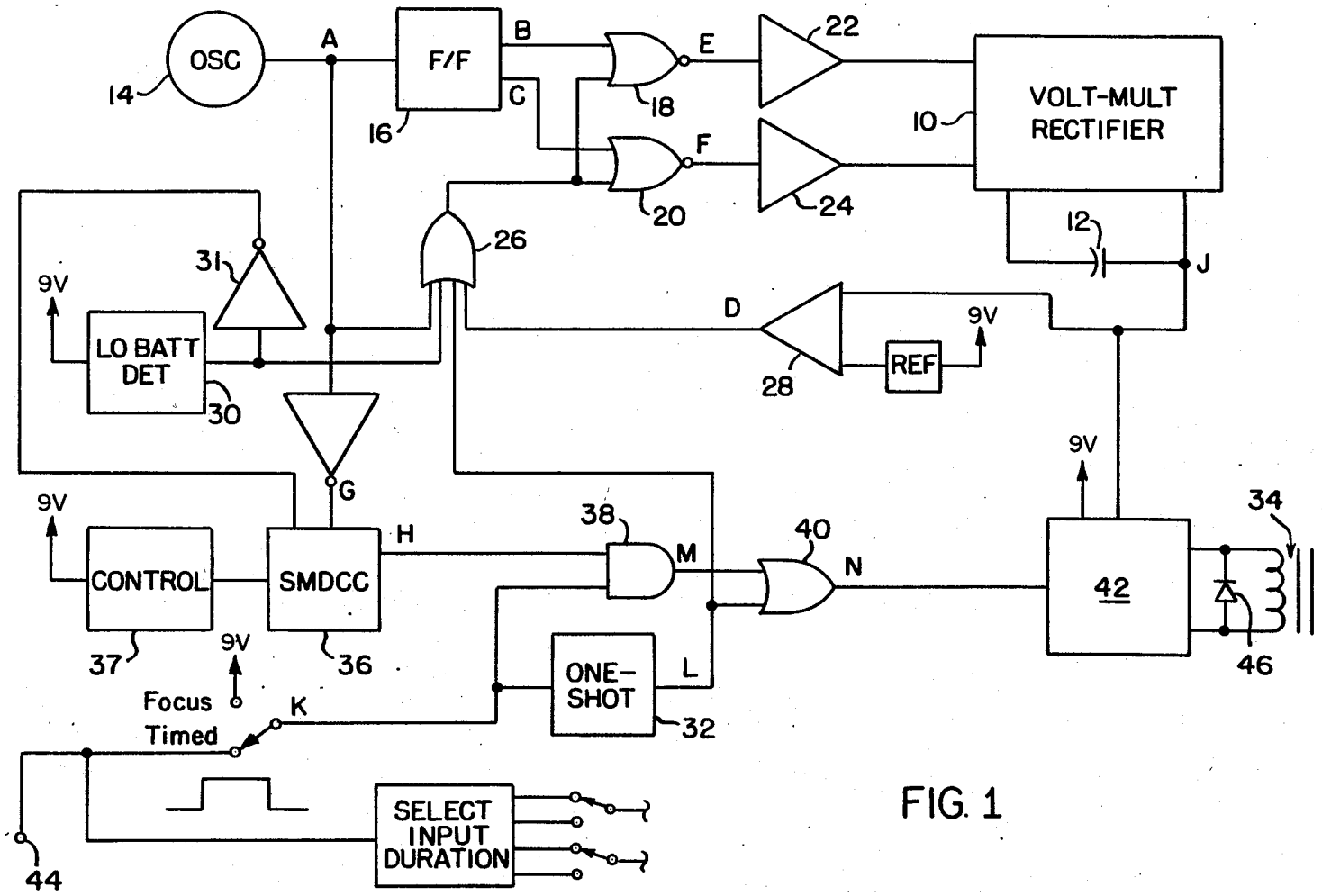
FIG. 1 is a simplified schematic block diagram of a circuit according to the presently preferred embodiment of the invention.
Figure 2A:
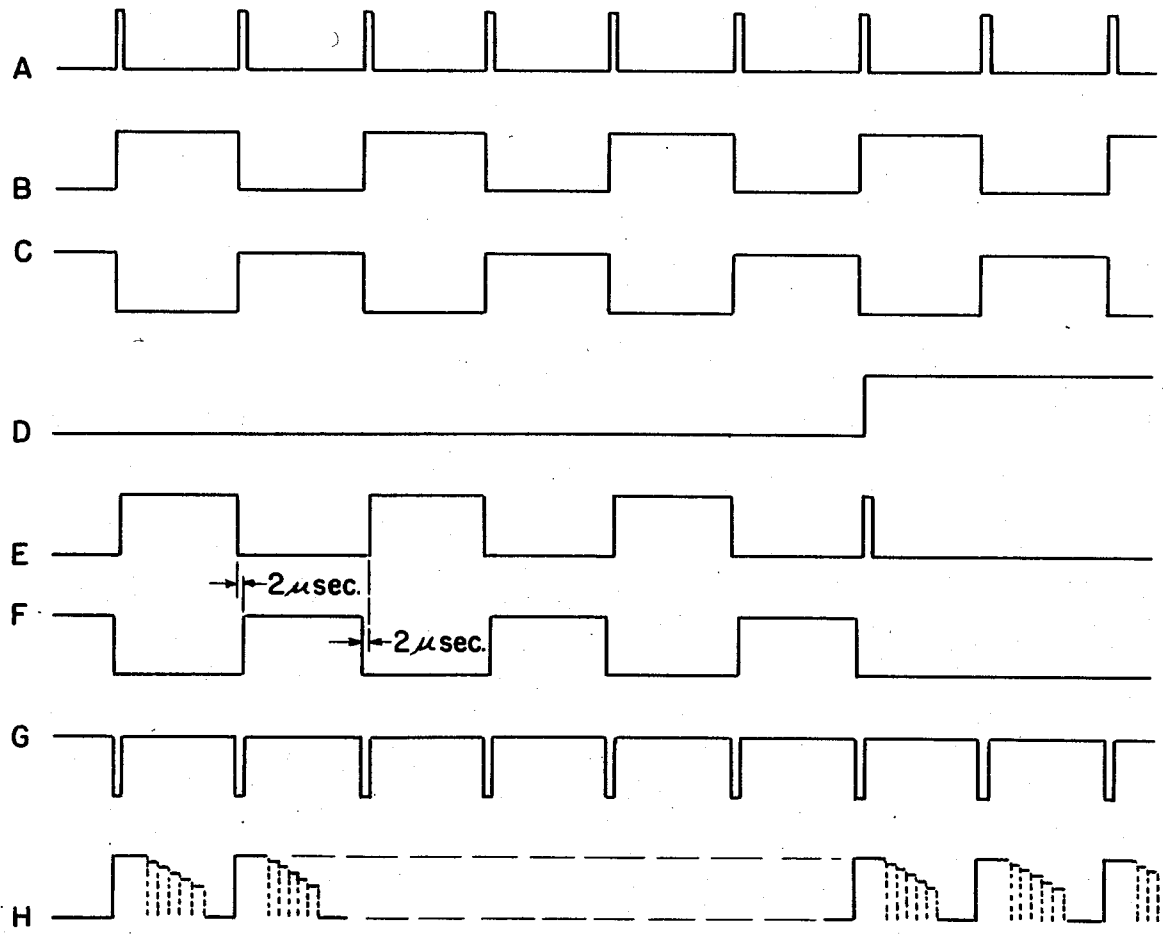
FIGS. 2A and 2B are a series of voltage wave forms illustrating the operation of the circuit and showing voltage changes at various referenced points in it.

Referring first to FIG. 1, the output of the voltage multiplying rectifier 10 is connected across the initiating capacitor 12 to charge it to a predetermined peak voltage of, typically, 35 volts. The input to the rectifier 10 is controlled by an oscillator 14, which, as shown in FIG. 2A, produces output pulses of about two microseconds duration at a rate of some twenty kilohertz. The oscillator 14 is connected through a flip-flop 16 and a pair of NOR gates 18 and 20, alternately to switch a pair of drive amplifiers 22 and 24 ON and OFF.

The output of the oscillator 14 is also connected to one input of an OR gate 26 to inhibit both of the NOR gates 18 and 20 during each of the two-microsecond output pulses of the oscillator, thus to ensure that the NOR gates remain inhibited during the two-microsecond duration of the clock pulse, otherwise both of the drive amplifiers 22 and 24 could be ON simultaneously during that interval causing a small, but undesired, extra power drain.

A second input to the OR gate 26 consists of the output of the high voltage comparator 28, which is connected to produce a signal to inhibit the NOR gates whenever the voltage across the capacitor 12 reaches 35 volts, and to maintain the signal, and thus continue holding the NOR gates inhibited, until the voltage on the capacitor drops to about 30 volts.

A third input to the OR gate 26 consists of the output of the low battery detector 30, which produces a signal whenever the voltage across the battry drops to about 5.5 volts.

The fourth input to the OR gate 26 is from a one-shot multivibrator 32 which is set to produce a signal of about 25 milliseconds duration at the beginning of each output pulse delivered to the load 34, thus to inhibit operation of the capacitor charging circuit (the voltage multiplying rectifier) during the interval when the capacitor is being discharged through the load.

Turning now to the system for producing the sustaining output signal for holding the load energized after the capacitor 12 has initiated its energization, the central part of the system is called the Supply Monitor Duty Cycle Controller, or the SMDCC 36. It is normally running while the circuit is in standby condition. It generates one output pulse immediately following each of the output pulses of the clock oscillator 14, the amplitude of the pulse being approximately equal to the instantaneous battery voltage.

The duration of the output pulses of the SMDCC 36 is responsive to a control circuit 37, and is an inverse function of the voltage across the battery. As the battery voltage drops, the amplitude of the output pulses of the SMDCC does also, but their duration increases to compensate for what would otherwise by a drop in the energy delivered to the load. Typically, with a new battery, and under optimum conditions, each pulse lasts about 40% of the time between the clock pulses, and, as the battery voltage declines, the pulses increase in duration to about 60% of the time. The duty cycle starts at about 40%, and then increases to about 60% as the battery voltage falls.

The output of the SMDCC 36 is connected through an AND gate 38 and an OR gate 40 tto the output drive amplifier 42. When the AND gate 38 is enabled in response to an input control signal from the control input terminal 44 the output of the SMDCC 36 is applied to the OR gate 40, and through the OR gate to the output driver 42. The input control signal is also applied to trigger the one-shot 32, and the output of the one-shot 32 is also applied to the OR gate 40. The output of the one-shot 32 overrides the output of the SMDCC 36 so that the output of the OR gate 40 immediately following the start of the input control signal consists of the output of the one-shot for the first twenty five milliseconds, and if the control signal persists for more than twenty five milliseconds, the output of the OR gate 40 after that interval consists of the output of the SMDCC 36 only.

The output of the low battery detector 30 is also fed to the SMDCC 36 through an invertor 31 to inhibit the SMDCC whenever the battery voltage falls below the predetermined minimum value.

The diode 46 connected across the load 34 and across the output of the driver 42 allows the inductive decay current generated in the load 34 immediately following each of the energizing pulses to flow with minimum hindrance, thus keeping the load energized during the intervals between the output pulses of the SMDCC 36. It has been found that marginally reliable operation of the inductive load constituted by the electromagnetically actuated shutter mentioned hereinabove can be achieved when the output pulses of the SMDCC 36 take up as little as 15% of the cyclic period. However, for reliable operation in the field it is presently preferred to maintain a minimum duty cycle of at least about 40%.

Figure 2B:
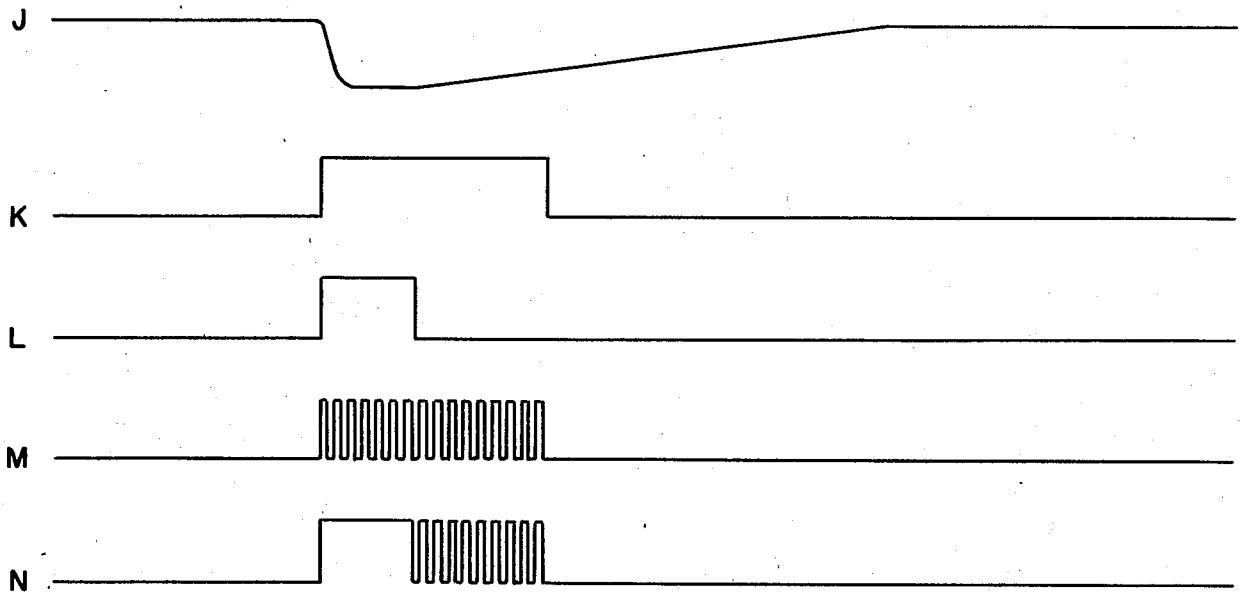

It is believed that the waveforms illustrated in FIGS. 2A and 2B need not be described in detail herein since they are referenced to respective points in the circuit, both in the block diagram of FIG. 1 and in the detailed schematic diagram of FIGS. 3–7, and should be clearly understandable in light of the description herein of its operation. The dashed portions of the curve designate H are intended to show the variable nature of the output pulses of the SMDCC 36 depending on the instantaneous value of the battery voltage. The leading edge of each of the output pulses of the curve will, of course, be only as high as the trailing portion; the pulses are essentially flat topped.

FIGS. 3, 4, 5, 6, and 7, when arranged as shown in FIG. 8, constitute a detailed, schematic diagram of the circuit according to the presently preferred embodiment of the invention. In all cases in the diagram where it is thought that the nature of the individual circuit components may not be clear from their positions in the circuit, they are labelled with their accepted commercial designations, and the pertinent individual pin connections to the IC chips are also given. Also, the reference characters used in FIGS. 3–7 have been selected to key the circuit components to the block components indicated in FIG. 1.

Figure 3:
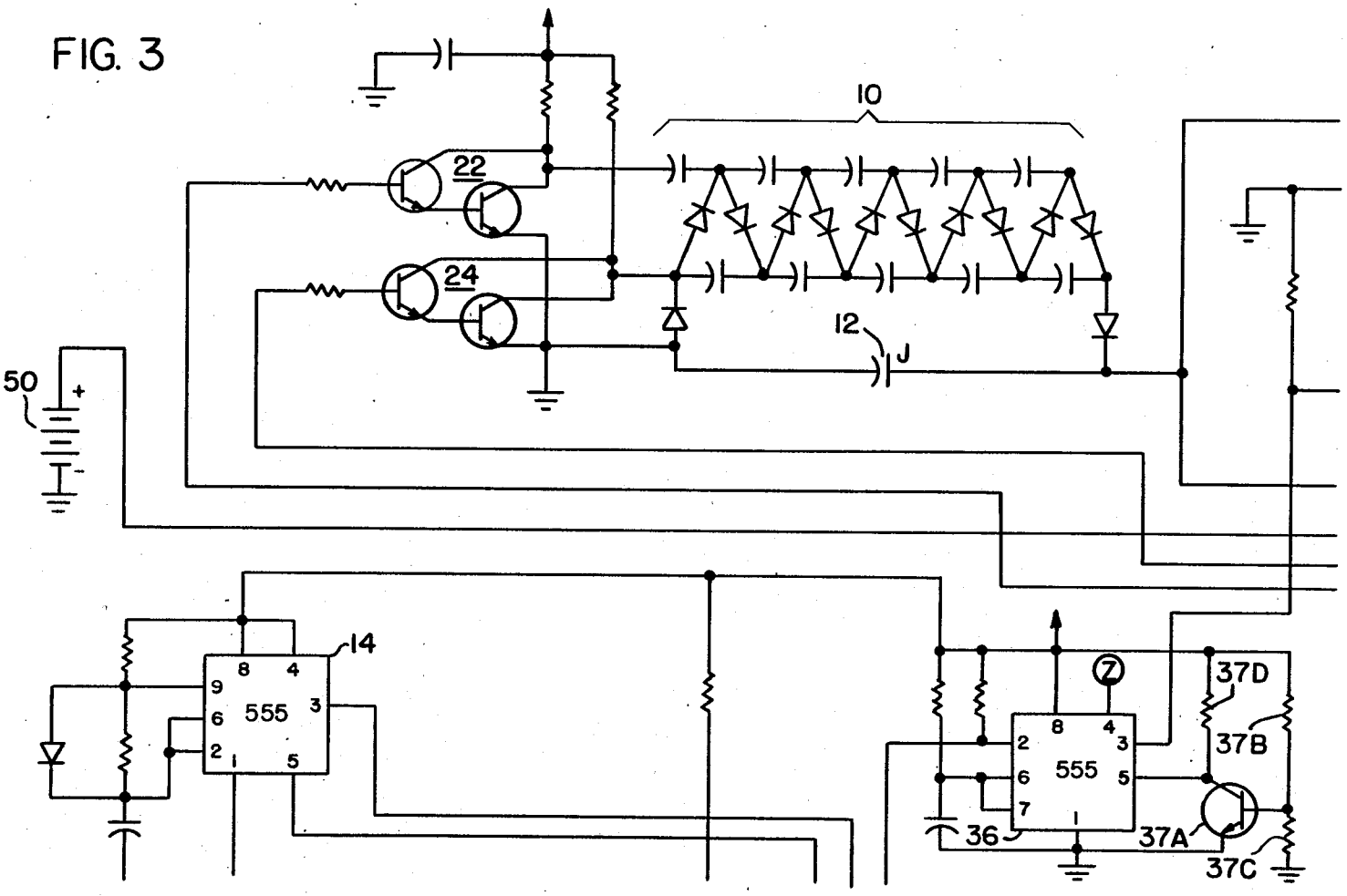
Figure 4:
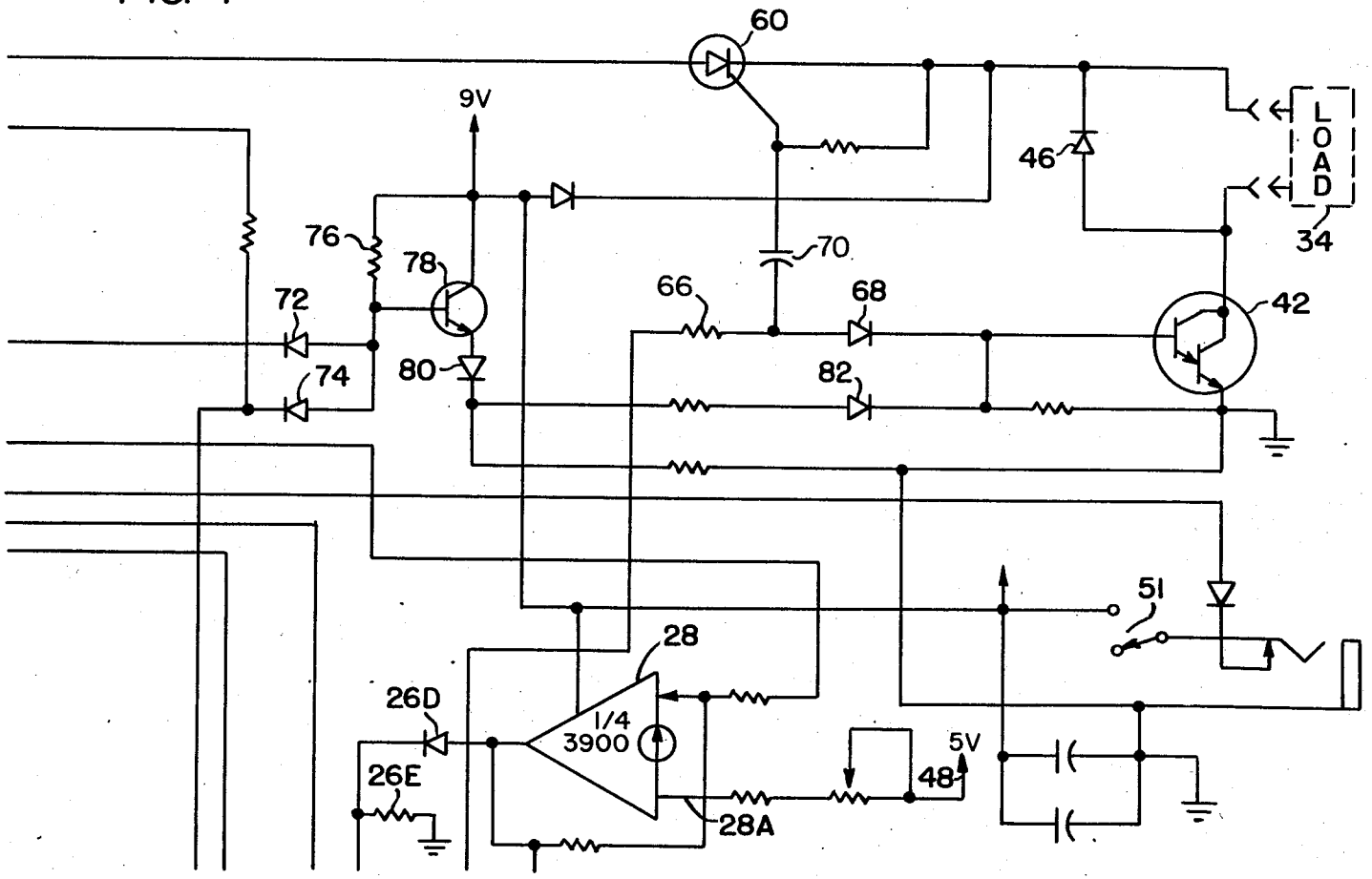
Figure 5:
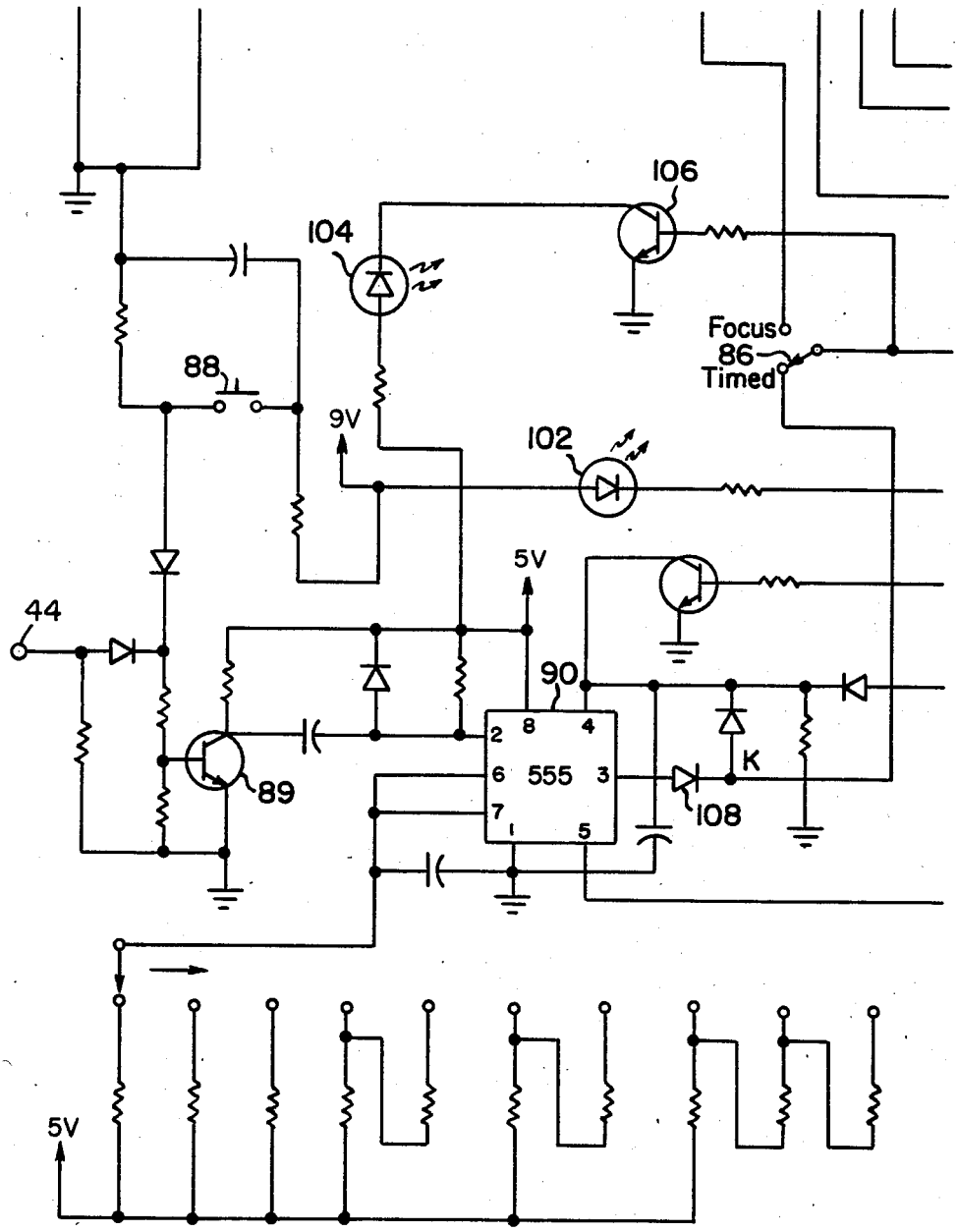
Figure 6:
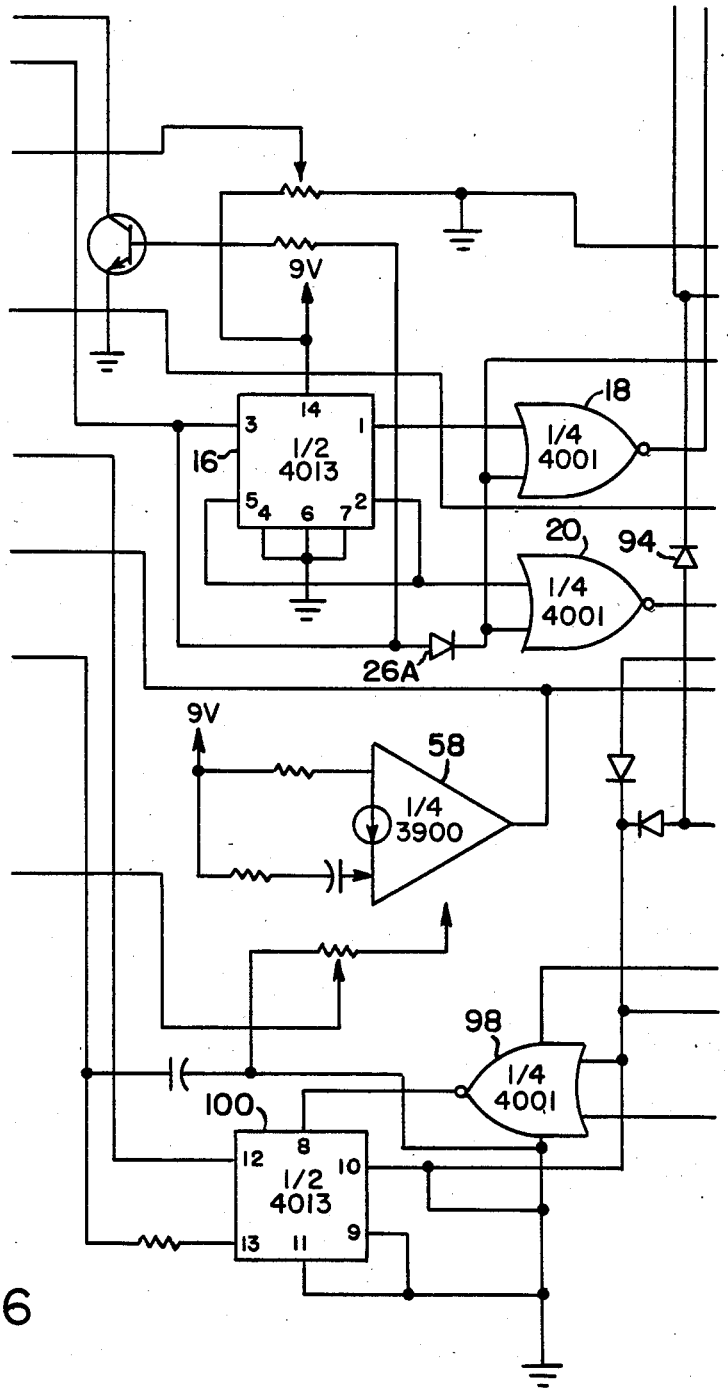

In the detailed diagram, the voltage multiplying rectifier 10 and the initiating capacitor 12 are shown at the upper part of FIG. 3. The clock oscillator 14 is based on a 555 timer, and the toggle flip-flop 16 (FIG. 6) is one-half of a type 4013 dual D flip-flop IC. The OR gate 26 (FIG. 1) includes four diodes 26A (FIG. 6) 26B (FIG. 7) 26C (FIG. 7) and 26D (FIG. 4) and a hold-down resistor 26E. The SMDCC 36 (FIG. 3) is also based on a 555 timer. The control circuit 37 includes a transistor 37A, a pair of voltage divider resistors 37B and 37C, and the collector resistor 37D.

The output of the oscillator 14 (FIG. 3) taken from pin 3, drives the toggle flip-flop 16 (FIG. 6) the output of which is applied to respective inputs of the NOR gates 18 and 20. The outputs of the NOR gates 18 and 20 are applied, respectively, selectively to inhibit the amplifiers 22 and 24 which drive the rectifier 10 thereby to charge the initiating capacitor 12.

Operation of the drive amplifiers 22 and 24 is also subject to control responsively to the output of the high voltage detector 28 (FIG. 4) which inhibits the amplifiers 22 and 24 when the voltage across the initiating capacitor 12 reaches about 35 volts, and holds the amplifiers inhibited until the voltage across the initiating capacitor drops to about 30 volts. The reference input 28A of the differential amplifier is connected to a regulated voltage source 48 (FIGS. 4 and 7), which may be conveniently selected to be about 5 volts, a value below the minimum voltage of the main battery 50, at which the circuit is controlled to shut down automatically. In this way, the initiating capacitor is alays charged to approximately the same voltage regardless of deterioration in the output voltage of the main battery.

In this connection it may be pointed out that the voltage of the main battery 50 usually is found to start at close to its nominal value of 9 volts, then, as its power is drained, it falls to about 8 to about 8.5 volts, and holds at that voltage for a considerable duty time. Thereafter if falls to about 7.5 volts, and holds between 7 and 7.5 volts for a considerable additional duty. Each time the circuit is turned OFF the battery recuperates, so that when it is again turned ON the output voltage of the battery is considerably higher than when the cicruit was last turned OFF. When, however, the output voltage drops to about 5.5 volts it has been found that it rarely recuperates to as much as 8.0 volts.

The circuit of the invention includes a detector and control portion that shuts down the circuit, along with all its output functions whenever the battery voltage drops to 5.5 volts. This is the low battery detector 30 (FIG. 7) a type 7665 IC, the output of which is fed from its pin 7 through an amplifier 52 and the OR gate diode 26B to inhibit the NOR gates 18 and 20. The inhibit signal is then held on the NOR gates until the battery voltage returns to at least about 8 volts, or until the main power switch 51 (FIG. 4) is turned OFF, or the battery 50 is removed.

During development of the circuit the detector 30 was at first arranged to shut down the circuit when the battery output fell to 5.5 volts, and to reverse its condition, restoring circuit operability, when the battery output recuperated to between 7 and 7.5 volts. the results of that arrangement were unsatisfactory, however, because soon after the detector would shut down the circuit the battery would recuperate to something over 7 volts, causing the detector 30 to reverse condition and restore the circuit. The effect was a slow motorboating kind of ON-OFF oscillation, and charging of the capacitor 12 became unreliable while it was going on.

To avoid this problem, the upper, restore value for the detector 30 was set at at least 8 volts, significantly higher than the recuperative ability of the battery following its deterioration to 5.5 volts. A problem remained, however, because a good deal of useful life remained in the battery even when its working voltage dropped below 8 volts. For example, if the battery voltage was between, say, 7.0 volts and 7.5 volts, the low battery detector 30 would prevent the circuit from turning ON after it had been turned OFF. To allow turning ON under this kind of condition, the output of the low battery detector 30 is inhibited during a short period following turn ON of the circuit by a transistor 54 (FIG. 7) which is gated ON to short circuit the control resistor 56 of the low battery detector 30 in response to the output of a timer 58 (FIG. 6) which times out about 25 msec. following turn ON of the circuit.

Thus, no matter how low the battery may be, the circuit can be turned ON, i.e., "powered up", and it will remain on and be operative to whatever degree the condition of the battery 50 allows until the timer 58 times out. If at any time following time out of the timer 58, the battery output is found to be below 5.5 volts, the low battery detector 30 operates to inhibit all functions of the circuit including charging of the initiating capacitor 12 and energization of the load.

The initiating capacitor 12 discharges through the load in response to the simultaneous triggering of a triggerable avalanche device such as the SCR 60 shown (FIG. 44) and actuation of the output driver 42, which may be a Darlington pair, as shown, that acts as a switch to connect one terminal of the load to ground. The circuit portion by which the action is initiated starts at the ACTUATE switch 88 (FIG. 5) actuation of which operates an isolating transistor 89 to trigger the exposure timer 90 by applying low voltage to its trigger pin 2. The output of the exposure timer 90 is taken from its pin 3 through the FOCUS-TIMED switch 86 to an input of a buffer amplifer 92 (FIG. 7). The output of the amplifier 92 is applied through a diode 94, a resistor 95, and a capacitor 97 to an input of the one-shot multivibrator 32. The output of the one-shot 32 is fed through a resistor 66 and a capacitor 70 to the trigger electrode of the SCR 60, and through the resistor 66 and a diode 68 to the input base electrode of the output amplifier 42, thus simultaneously triggering the SCR 60 and enabling the output amplifier 42.

The output of the one-shot 32 ends at the end of either its period or the exposure time signal from the timer 90, whichever occurs first. If the exposure time is shorter than the period of the one-shot 32, the action ends at the end of the exposure time; the one-shot 32 turns OFF, the output amplifier 42 is shut OFF, current from the capacitor 12 through the SCR 60 is shut off, the SCR 60 is re-set, and charging of the capacitor 12 starts again.

If the exposure time is longer than the period of the one-shot 32, the signal from the one-shot ends when it times out, and the operation of the output amplifier 42 is controlled responsively to the SMDCC 36 from then until the end of the exposure time.

The output of the one-shot 32 is also applied through the OR gate diode 26C to inhibit the amplifiers 22 and 24 that drive the rectifier 10, so charging of the capacitor is inhibited until the one-shot 32 times out or is turned OFF.

After the one-shot 32 times out in cases when the input signal still persists beyond its period, the operation of the output driver 42 is responsive tot he SMDCC 36 (FIG. 3). The output of the SMDCC from pin 3 is applied through the AND gate made up of the diodes 72 and 74 and the resistor 76 to operate the buffer transistor 78, the output of which drives the output driver 42 through the diodes 80 and 82.

The SMDCC 36 is arranged to provide an output square wave signal having a duty cycle inversely proportional to the main battery voltage, as indicated by the curve F of FIG. 2B. This is accomplished by the control circuit, which includes the transistor 37A, the voltage divider resistors 37B and 37C, and the bias resistor 37D, and the output of which is connected to pin 5 of the 555 timer. So far as is known this is a unique control arrangement with the 555 timer, causing the duration of its output pulses to increase in proportion to decreases in the battery voltage. The 555 timer itself is described in detail, and also many different circuit arrangements using it, in a text entitled "IC Timer Cookbook" by Walter G. Jung, published in 1979 by Howard W. Sams and Co., Inc., Indianapolis, Ind. 46268.

The circuit points marked Z within a circle, pin 4 of the SMDCC timer 36 in FIG. 3, and pin 7 of the low battery detector 30 in FIG. 7, are a common point, and are represented by the code letter Z to avoid unduly confusing the schematic diagram.

Energization of the load 34 is initiated either by actuation of the manual control switch 86 (FIG. 5) labelled FOCUS-TIMED to its FOCUS position, or the ACTUATE switch 88. The manual switch 86 is used when it is desired, for example, to open the shutter and hold it open while focussing the apparatus it is used with. The ACTUATE switch 88, when actuated, applies battery voltage to trigger the timer circuit including the 555 timer 90, the output of which is applied through the TIMED contact of the manual switch 86 to one input of a buffer amplifier 92. The output of the amplifier 92 is applied through a diode 94 to an input of the one-shot 32 to trigger the SCR 60 and enable the output amplifier 42 as, hereinabove described, to initiate energization of the load 84.

The output of the high voltage detector 28 (FIG. 4) is also applied to both inputs of a NOR gate 96 (FIG. 7) which operates as a simple invertor to drive a second NOR gate 98 (FIG. 6) the output of which triggers a flip-flop 100. One output of the flip-flop 100 energizes the READY LED 102 (FIG. 5) thereby signalling the user that the initiating capacitor 12 is fully charged and the circuit is ready for the next actuation of the load. A second output of the flip-flop 100 (pin 13) is applied to enable the timer 90, which is inhibited during initial charging of the capacitor 12.

A second LED 104, controlled by a transistor 106, is energized either through the FOCUS-TIMED switch 86 when it is in its FOCUS position, or from the output of the timer 90 through the diode 108 and the switch 86 to provide a visual indication that the load is currently being energized.

What is claimed is:

1. Method of energizing an inductive load from a battery comprising connecting a unidirectional current device across the load, and applyng timed-spaced pulses of current from the battery to the load, the sum of the pulses during any selected period being substantially less than the integrated value of the nominal holding current requirement of the load during the selected period, the inductive nature of the load causing current to continue to flow through it and the unidirectional device during the intervals between the applied pulses, the continuing current being adequate to maintain the load in its fully energized condition during the intervals, continuously sensing the output voltage of the battery, and causing the individual pulses of current to increase in duration in accordance with the extent of the drop in the output voltage of the battery from its initial value whereby the pulses become longer as the output voltage of the battery dwindles.

2. A circuit for energizing an inductive load from a battery comprising a unidirectional current device, means connecting said device across the load, controllable switch means for selectively applying current from the battery to the load, the polarity of the applied current being in the blocking direction relative to the unidirectional current device, and control means for operating said switch means to apply current in time-spaced pulses to the load, said control means including sensing means for continuously sensing the output voltage of the battery and for varying the duration of said pulses inversely in accordance with variations in the instantaneous output voltage of the battery.

3. A portable actuator for an inductive load comprising a capacitor, voltage multiplier means for charging said capacitor from a battery to a voltage substantially greater than the output voltage of the battery, a triggerable avalanche device, connecting means including a switch for connecting an inductive load across the capacitor in series with said avalanche device and said switch, trigger means for triggering said avalanche device and simultaneously closing said switch to initiate energization of the load by discharge of the capacitor through it in response to a preselected input signal, limit means for opening said switch and thereby positively inhibiting said avalanche device at a predetermined interval following operation of said trigger means, an oscillator for producing time-spaced pulses of current at a voltage approximately equal to the instantaneous output voltage of the battery, said limit means also including means responsive to said oscillator for alternately closing and opening said switch for a predeterminable time immediately following said predetermined interval, and control means responsive to variations in the instantaneous output voltage of the battery for increasing the duration of the time-spaced pulses in response to a decrease in the battery output voltage.

* * * * *